US009388016B2

(12) United States Patent
De Matteis

(10) Patent No.: US 9,388,016 B2
(45) Date of Patent: Jul. 12, 2016

(54) STRUCTURE OF MULTIPURPOSE SHEET FOLDING AND STACKING MACHINE

(75) Inventor: Alessandro De Matteis, Lucca (IT)

(73) Assignee: MTC-MACCHINE TRANSFORMAZIONE CARTA S.R.L., Porcari (IT)

( * ) Notice: Subject to any disclaimer, the term of this patent is extended or adjusted under 35 U.S.C. 154(b) by 1041 days.

(21) Appl. No.: 13/389,056

(22) PCT Filed: Aug. 5, 2009

(86) PCT No.: PCT/IB2009/006459

§ 371 (c)(1),
(2), (4) Date: Apr. 23, 2012

(87) PCT Pub. No.: WO2011/015893

PCT Pub. Date: Feb. 10, 2011

(65) Prior Publication Data

US 2012/0202670 A1 Aug. 9, 2012

(51) Int. Cl.
*B31B 1/26* (2006.01)
*B65H 45/24* (2006.01)

(52) U.S. Cl.
CPC ..... *B65H 45/24* (2013.01)

(58) Field of Classification Search
CPC .. B65H 45/18; B65H 45/24; A61F 13/15747; B31F 1/003; B31F 1/009; B31B 1/26
USPC ..... 493/405, 411, 413, 427, 428, 430, 433, 493/434, 448
See application file for complete search history.

(56) References Cited

U.S. PATENT DOCUMENTS

| | | | | |
|---|---|---|---|---|
| 2005/0124481 | A1 * | 6/2005 | d'Agrella et al. | 493/405 |
| 2006/0052228 | A1 * | 3/2006 | De Matteis | 493/360 |
| 2006/0154794 | A1 * | 7/2006 | Couturier et al. | 493/427 |
| 2009/0253564 | A1 | 10/2009 | Butterworth | |

* cited by examiner

*Primary Examiner* — Andrew M Tecco
(74) *Attorney, Agent, or Firm* — Ladas & Parry LLP

(57) ABSTRACT

A folding and stacking machine of a web of paper has first and second feed lines. The machine also has a folding section with folding rollers having a linear folding speed, VP. The folding rollers are adapted to receive a plurality of sheets of length L that can overlap each other for a fraction Y of their length L and to fold them into a plurality of panels P. The machine also has rollers adapted to feed at the folding speed $V_P$ the series of cut sheets but not yet folded towards the folding rollers. The rollers are located at the confluence of the two sheet feeding lines. Upstream of the first and feed lines a single cutting section is provided to cut a web of paper that proceeds along a direction of movement at a speed V(1).

18 Claims, 9 Drawing Sheets

STRUCTURE OF MULTIPURPOSE SHEET FOLDING AND STACKING MACHINE

This application is a 371 of PCT/IB2009/006459, filed on Aug. 5, 2009, the content of which is incorporated herein by reference.

FIELD OF THE INVENTION

The present invention relates to the production of paper material in stacks of sheets, for example interfolded sheets, and, in particular, it relates to a structure of folding and stacking machine of such sheets.

BACKGROUND OF THE INVENTION

As well known, in the paper converting industry a variety of types is used of machines and of processes for making paper tissue packs, paper towels and similar articles, in stacks of sheets of a certain height.

In many applications the packs are obtained by stacking the sheets in an "interfolded" way, i.e. at each fold a wing of a previous sheet and a wing of a next sheet engage with each other. This way, when drawing a sheet from a package, at the moment of the use, also a wing of a next stack panel is dragged away, up to protruding from the package, with subsequent practical function for certain types of users. Among possible interfolding ways the L-type, with 2 panels (single fold), or the Z or W types, respectively with 3 and 4 panels (multi fold), are known.

In other applications the packs are obtained by folding the sheets in a not interfolded way, by folding sheets that are not overlapped to one another, or sheets that are overlapped but holding them in such that that a panel of a previous sheet is not enclosed in a panel of a immediately successive sheet.

The folding and stacking machines use one or more webs of paper that come from one or more reels and that are cut into sheets and fed in a way overlapped or not overlapped on two folding counter-rotating rollers.

More precisely, for example as disclosed in U.S. Pat. No. 6,228,014, the webs are cut into sheets by means of cutting rollers that interact alternatively, with relative counter-support blades. In case of L-type interfolding (single-fold machines) the webs are cut to form a shifted succession of sheets coming from two different directions. Then, the sheets coming from either directions are fed in an alternated way to the folding rollers, so that each sheet coming from the first direction is overlapped with a portion of the sheet coming from the second direction, and vice-versa. In general, they are overlapped about at the middle of the sheets.

The sheets coming from the two directions, in order to be folded in the way above described, adhere to the respective folding rollers by a holding system comprising either suction holes or mechanical clamps. Then, the downstream portion of each sheet leaves a respective folding roller at the contact line between the two rollers, held by the other folding roller, which is holding already the upstream portion of the previous sheet.

A problem that is felt with single-fold machines is a high encumbrance. In fact, they require two different paper web supply paths. Each paper web path requires two unwinding rollers, for unwinding two large paper supply rolls, a couple of embossing rollers and a plurality of deflecting rollers, for bringing the web of paper up to the entrance of the single-fold machine. In addition there are double costs for monitoring two paper web supply paths, and for making for each path a junction of two web ends when each of the supply rolls is ended.

In case of Z or W type interfolding, i.e. with three and four panels that are obtained by making respectively two or three folds for each sheet, or even in case of much more folds, multi-fold machines are used as disclosed in U.S. Pat. No. 3,490,762, where the interfolding method is similar as described above, with the difference that the overlapping step between two successive sheets is carried out immediately after the cut and a stream of partially overlapped sheets reaches the folding rollers from a single direction, with the effect that the sheets are overlapped always on a same side. In particular the overlapping step is carried out by a speed difference of the sheets, which during the cut have a first speed $V_1$, and are transferred on an overlap roller, which travels at a second speed $V_2$ less than said first speed $V_1$, so that by raising the tail of a previous sheet the head of a next sheet slips under this tail owing to the above described speed difference.

Also here, a suction system or a holding system with mechanical clamps causes to the flow of overlapped sheets, starting from the line of contact between the two rollers, to follow alternatively one or the other roller, creating an "accordion" that is progressively flattened creating a stack of interfolded sheets.

In particular, the folding rollers have a linear speed equal to $V_P=V_2$ and a circumference equal to a multiple to the double of the length of the sheet. Therefore, one of the parameters of reference is the panel length, which coincides with the width of final product and affects the diameter of the folding rollers. This parameter determines the size of the folded sheet being stacked, i.e. the width of the interfolded sheets packages. In view of that, one of the parameters of reference for a multi-fold interfolding machine is the stack width.

Another reference parameter for an interfolding machine is the length of the sheets, also called cut-off length. In particular, the length of the interfolded sheets that eventually form the stack of final product is responsive to the circumference of the cutting rollers and to the angular distance among the cutting blades. In other words, the cutting length is fixed and is determined univocally by the circumference of the cutting roller or rollers.

The need is felt for a flexible production of folded stacks of sheets, either interfolded or not, in order to make, according to the needs of the market, stacks of different width, or stacks of sheets that are folded into a different number of panels. In general, a folding and stacking machine is rather stiff, and provides a single panel width and a single type of product, for example L, Z, W-like interfolded types in case of interfolded products. It is not possible, in general, to change the production type except from the cases described below.

By changing the width of the packages it is possible to make different interfolded products, capable of meeting the needs of different markets. In EP1630118, in the name of the same applicant, an interfolding machine is described that allows a quick change of only the folding rollers, or only the folding section, allowing an adjustment of the length of the sheets and of the panel length, and then the width of the packages of interfolded sheets, without adjusting other parts of the machine, and without the need of a time for setting up the machine.

By changing only the length of the sheets, or cut-off, it is possible to keep a same pack width, by adjusting the number of interfolded panels. It can be in particular preferable to adjust the cut-off length without changing the pack width, leaving the user a variety of choices for making packs, in order to put different products in a same type of folded sheet dispenser. A common folding machine of "multifold" type allows to produce folded sheets of a single length and a single fold configuration of the panels, with an extremely stiff process, and for each sheet length a different machine is required.

In EP 1826165, in the name of the same applicant, an interfolding machine is described of multi-fold modular type, in which it is possible to cut a web of paper into sheets of different length after replacing a modular portion comprising the cutting roller and the transfer roller with another modular portion comprising a cutting roller and a transfer roller of different diameter, and then capable of cutting the web into sheets of different length and causing the sheets to be transferred to an overlapping section. This solution overcomes the limits of the multi-fold interfolding machines of traditional type, i.e. that cut a web of paper into sheets and process the sheets of a single length.

Owing to an increase of the variety of products required by the market, the companies need always more flexible machines, which in general are capable of folding sheets having a different number of folds, i.e. with a variable number of panels.

In particular, notwithstanding, on the one hand, interfolding machines exist that allow to adjust the panel length and then the pack width, and, on the other hand, interfolding machines exist that allow to adjust the length of the sheet, and then to make interfolded products with different number of panels, there are not machines that allow to provide in a flexible way both single-fold products, i.e. L-type interfolded sheets with two panels and one fold, and multi-fold products, for example Z-type interfolded sheets with three panels and two folds, or W-type interfolded sheets with four panels and three folds, or sheets with five or six panels.

In fact, the multi-fold machines, even if, as above said, can adjust the number of panels, as described in EP1826165, do not allow making L-type interfolded sheets, i.e. single-fold. Similarly, the single-fold machines are not suitable for making multi-fold products.

Moreover, other machines exist for making folded and stacked products that are not interfolded. Even in this case, they are stiff machines specifically designed for a certain product, concerning the number panels into which the panel is folded and concerning the configuration of the fold.

Also in case of modular machines that are capable of making more different interfolded products, the need is felt to minimize their size.

SUMMARY OF THE INVENTION

It is therefore a feature of the present invention to provide a structure of sheet folding and stacking machine of single-fold type that is less cumbersome with respect to the single-fold machines of the prior art.

It is also a feature of the present invention to provide a structure of sheet folding and stacking machine that provides folded sheet stacks with possibility to change the sheet length, in order to provide folding configurations with different size and/or number of panels, either interfolded or not interfolded.

It is still a feature of the present invention to provide a folding and stacking machine that can work obtaining stacks of interfolded sheets both with one fold only (single-fold), and with several folds (multi-fold).

These and other features are accomplished by the folding and stacking machine, according to the present invention, to obtain packages of folded and stacked sheets starting from a web of paper, or similar material comprising:

a folding section comprising a first and a second folding roller, said first and second folding rollers adapted to fold said sheets into a plurality of panels and to form a stack of folded sheets;

a sheet feeding section for feeding sheets to said folding rollers, said sheet feeding section comprising a first sheet feeding means that is adapted to feed a first plurality of sheets to said folding rollers along a first feed line and a second sheet feeding means, that is distinct from said first sheet feeding means and that is adapted to feed a second plurality of sheets to said folding rollers along a second feed line, whose main feature is that upstream of said sheet feeding section one sheet supply section is provided for unwinding and conveying a single web of paper according to a feeding direction, that one cutting section is provided that is adapted to cut said web of paper, coming from said feeding direction, into sheets of paper having a determined length L, and that a means is provided for distributing alternatively, and selectively, said sheets of paper to said first sheet feeding means for creating said first plurality of sheets and to said second sheet feeding means for creating said second plurality of sheets.

This way, a sheet folding and stacking machine that needed two separate sheet feed lines, like a single-fold machine, owing to the present invention can now be supplied by a single paper web path, and then requires a single unwinding section, which normally provides an unwinding roller or more frequently a couple of unwinding rollers, and a single embossing or calendering section, which provides normally a couple of embossing or calendering rollers. On the other hand, as already shown, a traditional single-fold machine would need two different paper web supply paths, doubling the dedicated machine subgroups that are required to provide the paper web for forming the sheets and folding them. This solution, then, saves between 30 and 40% the encumbrance of the machine with respect to the prior art, since the encumbrance of the paper web supply paths of a known single-fold machine is normally much more than the encumbrance of the sheet cutting, folding and transfer sections. Such a reduction of the size allows to sheet package producers to exploit better the factory space, and then to increase the production, since in a same factory shed a 30/40% larger number of machines can be arranged. In addition to the reduction of the size there is also a corresponding and sensitive reduction of the costs, both for purchasing the machines, and for operation and maintenance thereof.

In particular, said means for distributing alternatively the sheets of paper between said first and said second sheet feeding means is arranged in said cutting section. This way, the machine has increased stiffness and is much less cumbersome.

Advantageously, said cutting section comprises a cutting roller, which has as input said web and as output said sheets, and said means for distributing alternatively said sheets of paper between said first and said second means for moving comprises:

a first hold means for holding said sheets on a first angular portion of the surface of said cutting roller, second hold means for holding alternately said sheets on a second angular portion of the surface of said cutting roller, such that when said second hold means holds said sheets on said second angular portion it supplies a sheet to said second plurality of sheets on said second feed line. In particular when said second hold means does not hold said sheets on said second angular portion a sheet is supplied to said first plurality of sheets on said first feed line.

This way, it is possible to make a distribution at a high speed of sheets and to form the two pluralities of sheets as if two distinct paper web supply paths had been provided, in order not to reduce the production rate of the machine with respect to the prior art.

Advantageously, the first and the second angular portions are at least in part overlapped. This way, there is not a loss of continuity to grip the sheets that have to reach the second feed line and form the second plurality of sheets.

In particular, the first angular portion can extend substantially from a point downstream of said cutting means up to a tangent point between the cutting roller and the first roller of said first feed line, whereas the second angular portion can extend substantially from the tangent point between the cutting roller and the first roller of said first feed line and a tangent point between the cutting roller and the second roller of said second feed line.

Advantageously, the cutting roller comprises a plurality of holes, said first hold means comprising a first suction means that is adapted to pneumatically connect said holes with a vacuum system at said first angular portion of said roller, for holding said sheets on said first angular portion and said second hold means comprises a second suction means that is adapted to selectively connect said suction holes with said vacuum system at said second angular portion of said roller, for holding selectively on said second angular portion only sheets that have to form said second plurality of sheets.

Advantageously, a means is provided to create a path-length difference between the path of the second feed line and the path of the first feed line, said path-length difference being such that the sheets of the first and second pluralities of sheets reach the folding section according to a determined configuration. In particular, it is avoided that the two pluralities of sheets reach the folding section in phase with each other, allowing that they reach the folding section shifted from each other, in particular to be folded in an interfolded way.

Preferably, the means to create a path-length difference $\Delta L$ comprises at least one phase reset roller in at least one among said first and said second sheet feeding means.

In particular, the, or each, phase reset roller is adapted to extend the path of the second feed line with respect to the first feed line for a length $\Delta L$ that is equal to half sheet, or equal to an odd multiple of half sheet, for example one sheet and a half, two sheets and a half. It is clear that, similarly, a roller can be provided that is adapted to extend the path of the first feed line with respect to the second feed line.

Advantageously, the first and the second feed lines comprise each a first portion in which said sheets are brought to a first speed $V_1$ and a second portion that is downstream of said first portion in which said sheets are brought to a second speed $V_P$, with $V_P<V_1$.

Advantageously, the sheet feeding section comprises a first speed deceleration roller in said first feeding means, said first speed deceleration roller adapted to decelerate the feeding speed of the first plurality of sheets from $V_1$ to $V_P$ before they reach the first folding roller and a second speed deceleration roller in said second feed line, said second speed deceleration roller adapted to decelerate the feeding speed of the second plurality of sheets from $V_1$ to $V_P$ before they reach the second folding roller.

Advantageously, the linear speed of the speed deceleration roller is half the linear speed of the transfer roller.

Advantageously, the supply speed of the web is double with respect to the linear speed of the folding rollers $V_P$.

In particular, $V_1$ is the double of $V_P$ in a single-fold configuration of the machine. Then, by feeding the sheets at a speed $V_1$ that is equal to the double of a normal folding speed of a single-fold machine, it is possible to keep the same productive capacity using one paper web path instead of two. An arrangement of $V_1=2V_P$ can be easily carried out, since the speed of a paper web path supply does not represent a technological limit, and can be very high. Instead, the folding speed is the reference technological limit for this type of machines.

Advantageously, a first actuating means is provided that is adapted to selectively start/stop said first sheet feeding means and a second actuating means is provided that is adapted to selectively start/stop said second sheet feeding means, in this connection a drive unit being provided.

In particular, the drive unit is adapted to operate the actuating means between a first and a second configuration, in such a way that:

in said first configuration said actuating means of said second feed line and said second hold means are stopped and said machine operates in a multi-fold way, interfolded or not interfolded, with a single plurality of sheets that are fed only through said first feed line;

in said second configuration said second actuating means is operated so that the sheets of said first plurality and the sheets of said second plurality reach from both feed lines a point of confluence, so that said machine operates in a single-fold way.

Alternatively, in the first configuration said actuating means of said first feed line are stopped and said second hold means are always active for all the sheets, so that said machine operates in a multi-fold way with a single plurality of sheets that are fed only through said second feed line. This way, it is possible to use as multi-fold feeding either the first or second feed line, at the user's choice, in order to have two possible operations as multi-fold machines, and to vary, for example, the length of the folded sheets.

In particular, in the first operative condition the speed deceleration roller acts as an overlap roller, and therefore according to a ratio X between the speed $V_1$ upstream of the speed deceleration roller and the speed $V_P$ downstream of the speed deceleration roller, a corresponding portion Y of the length L of the sheet overlaps a next sheet, obtaining a determined interfolded configuration.

Advantageously, in the first operative condition the first feeding speed $V_1$ has a ratio $X_1$ with respect to the folding speed $V_P$ that is selected from the group comprised of:

$X_1=3/2$, for Z-type folded sheets with one interfolded panel;

$X_1=4/2$, for W-type folded sheets with two interfolded panels;

$X_1=5/4$ for five panel folded sheets with one interfolded panel;

$X_1=6/3$, for six panel folded sheets with three interfolded panels;

$X_1=6/4$ for six panel folded sheets with two interfolded panels.

In an exemplary embodiment of the invention, the folding section is independently removable as a unit with respect to the cutting section, said folding section comprising at least two folding rollers and being replaceable with an equivalent folding section.

In particular, said folding section comprises two modules having each a folding roller.

Preferably, the cutting section that is adapted to operate at a speed $V_1$ to cut sheets of length $L_1$ is replaceable with an equivalent modular portion that is adapted to operate at a speed $V'_1$ with sheets of length $L'_1$, in order to adjust the length of the sheets and to work with a different cut-off length.

In a preferred exemplary embodiment, the phase reset roller is independently removable as a unit in order to change it when any among the length of the sheet, the width of the sheet, the folding configuration are changed.

In particular, said folding and stacking machine has a support frame for supporting the cutting roller, the folding rollers, the transfer rollers etc., and the removable portion of the folding section is independently removable as a unit from the support frame of the machine, so that the folding rollers are removed as a unit, or as two sub-unities, and can be replaced with an equivalent portion, wherein said or each unit or modular portion comprises also the supports of the rollers and the transmission parts, already set with respect to one another.

Alternatively, or in addition, the folding section has a left speed deceleration roller and a left folding roller that are removable independently from said frame as a left modular portion, and a right speed deceleration roller and a right folding roller that are removable independently from said frame as a right modular portion, said left and right modular portions being replaceable with equivalent portions, comprising any motion transmission means, all movable at said speed $V_P$, whereby for adjusting the diameter of said folding rollers it is possible to change said folding section and said overlap rollers.

Advantageously, also the phase reset roller can be replaced with a modular equivalent portion, but of different diameter in order to obtain a different delay of the sheets of the second feed line.

BRIEF DESCRIPTION OF THE DRAWINGS

Further characteristic and the advantages of the folding and stacking machine, according to the invention, will be made clearer with the following description of an exemplary embodiment thereof, exemplifying but not limitative, with reference to the attached drawings, in which like reference characters designate the same or similar parts, throughout the figures of which.

Figure 1:
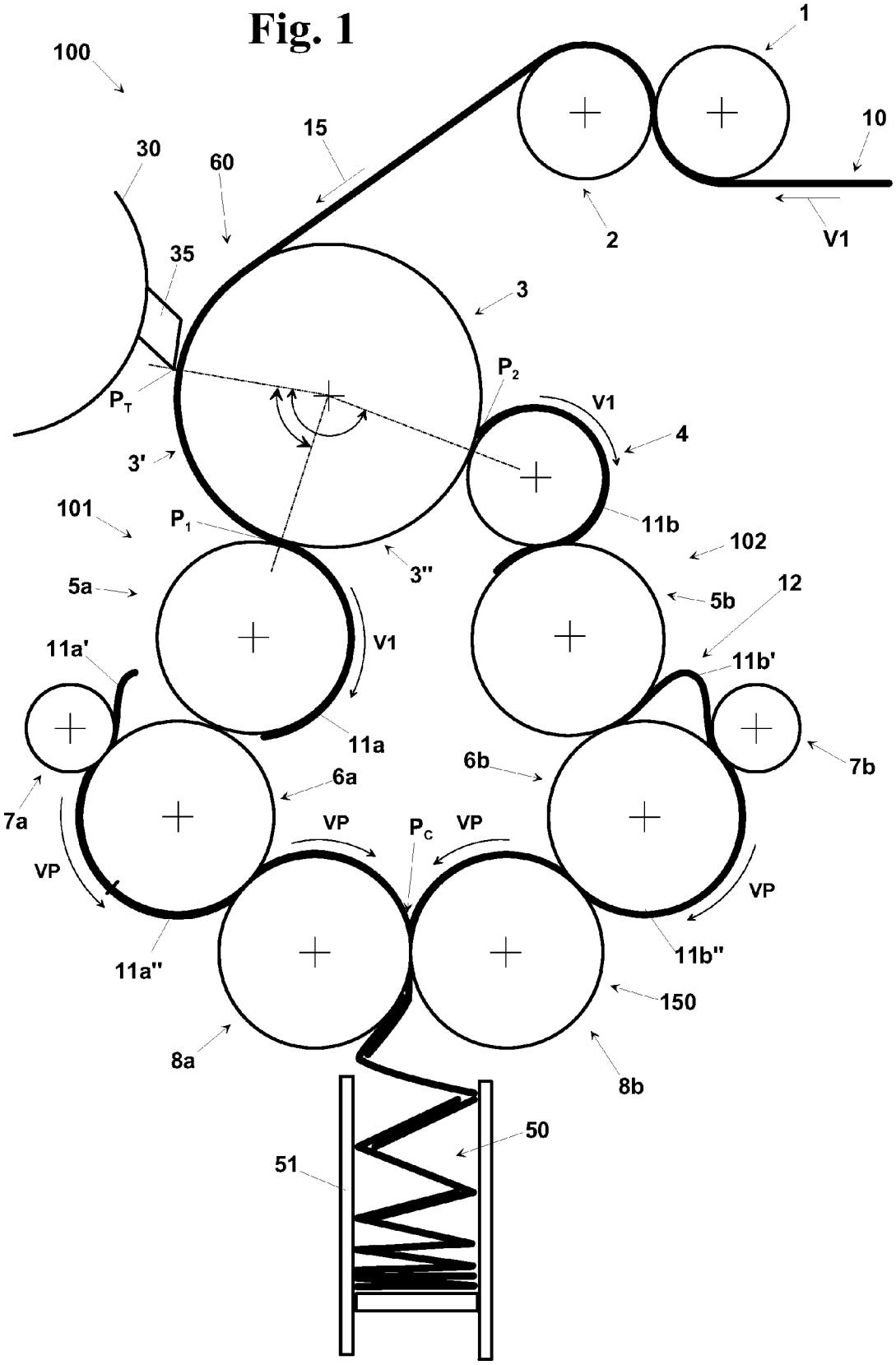
FIG. 1 diagrammatically shows an elevational side view of a first exemplary embodiment of the folding and stacking machine, according to the invention, with operation in single-fold way.
Figure 2:
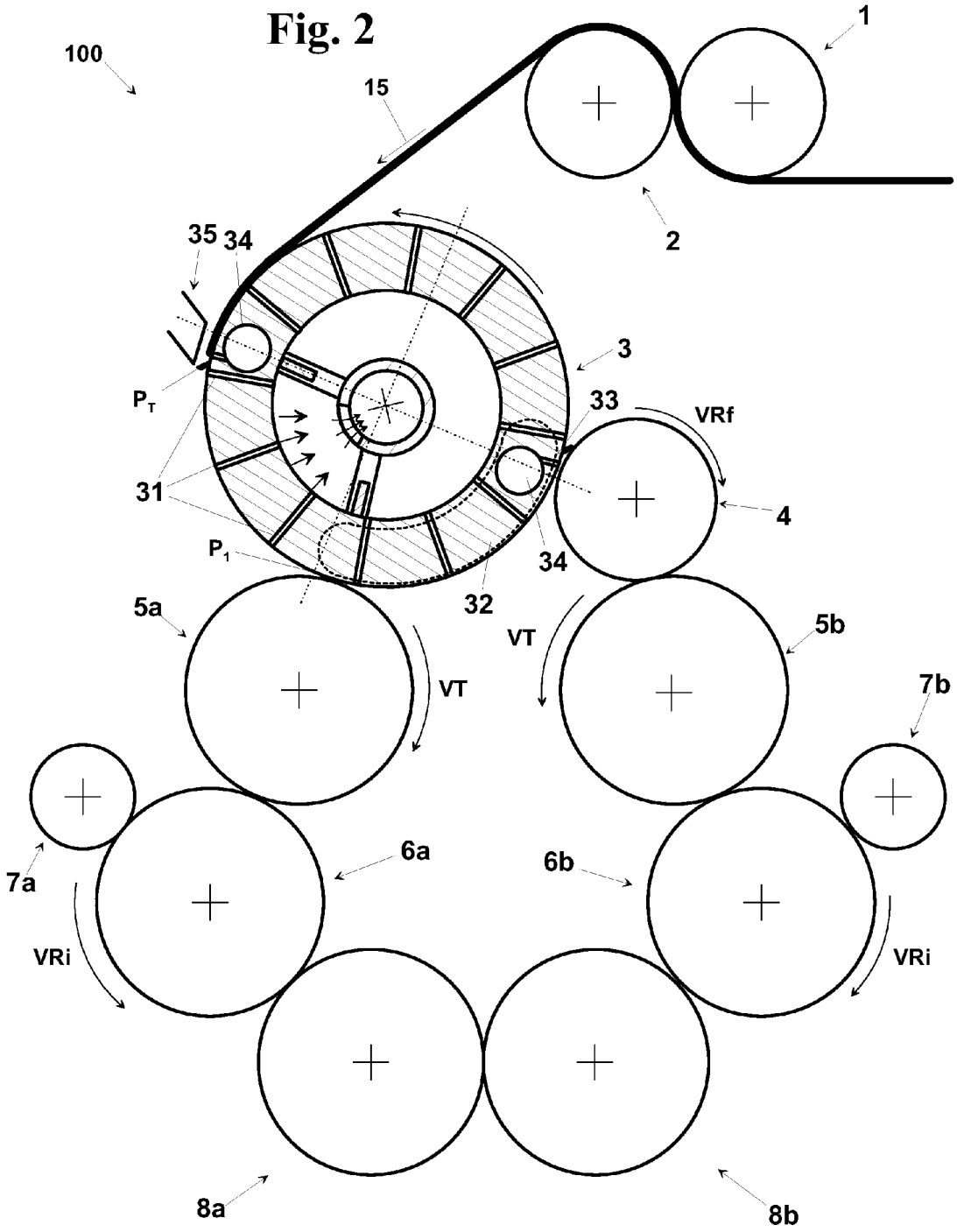
Figure 3:
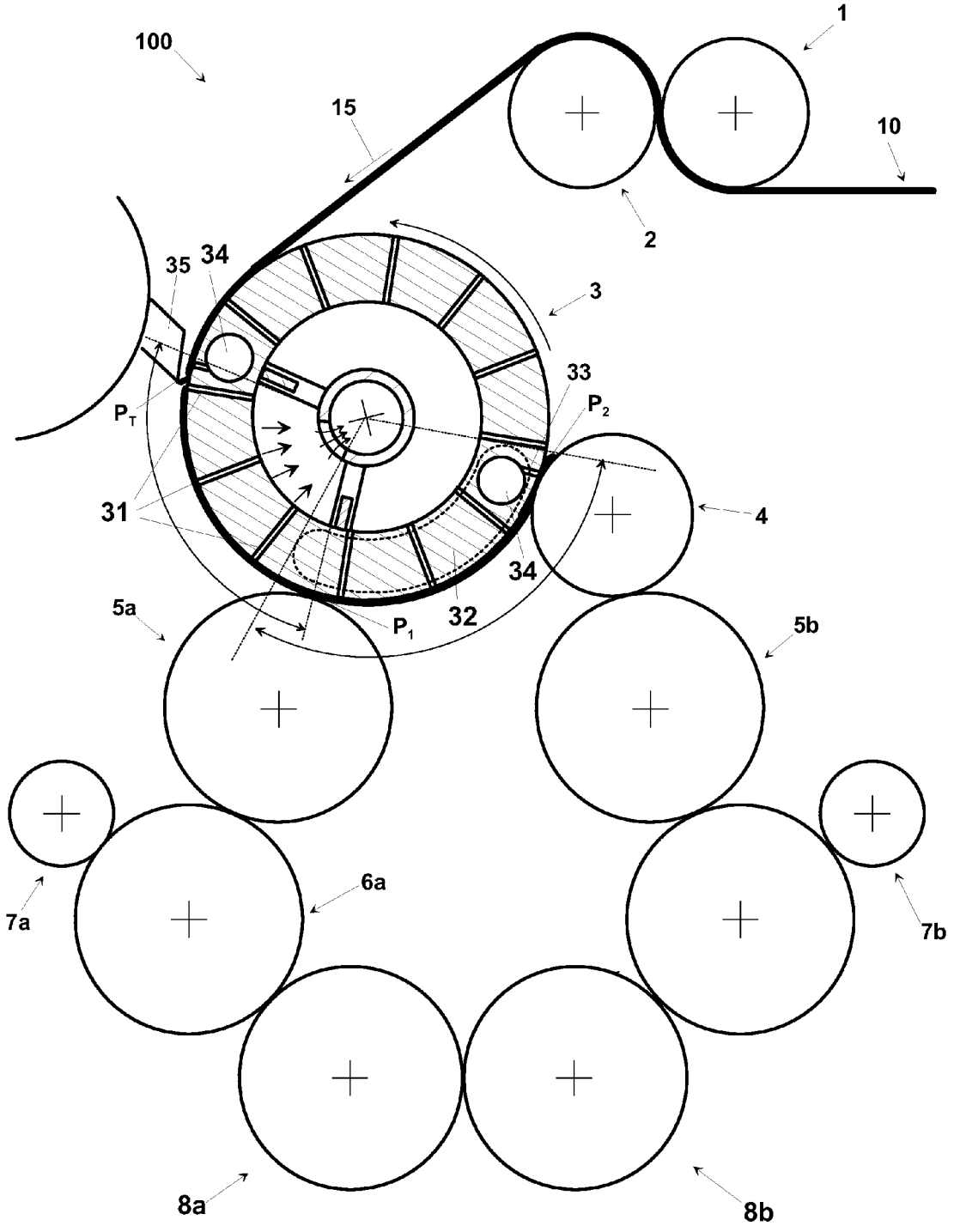
Figure 4:
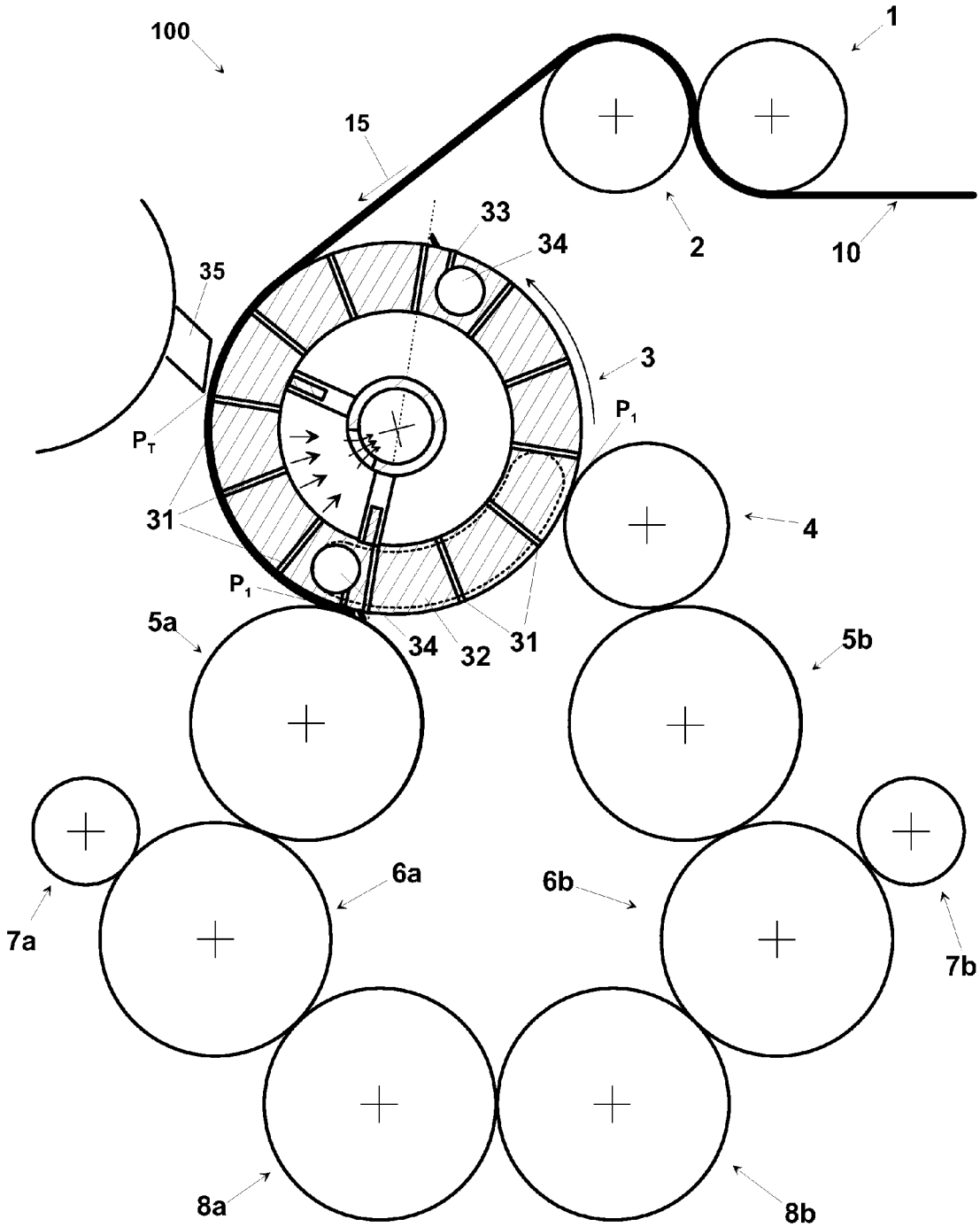
Figure 5:
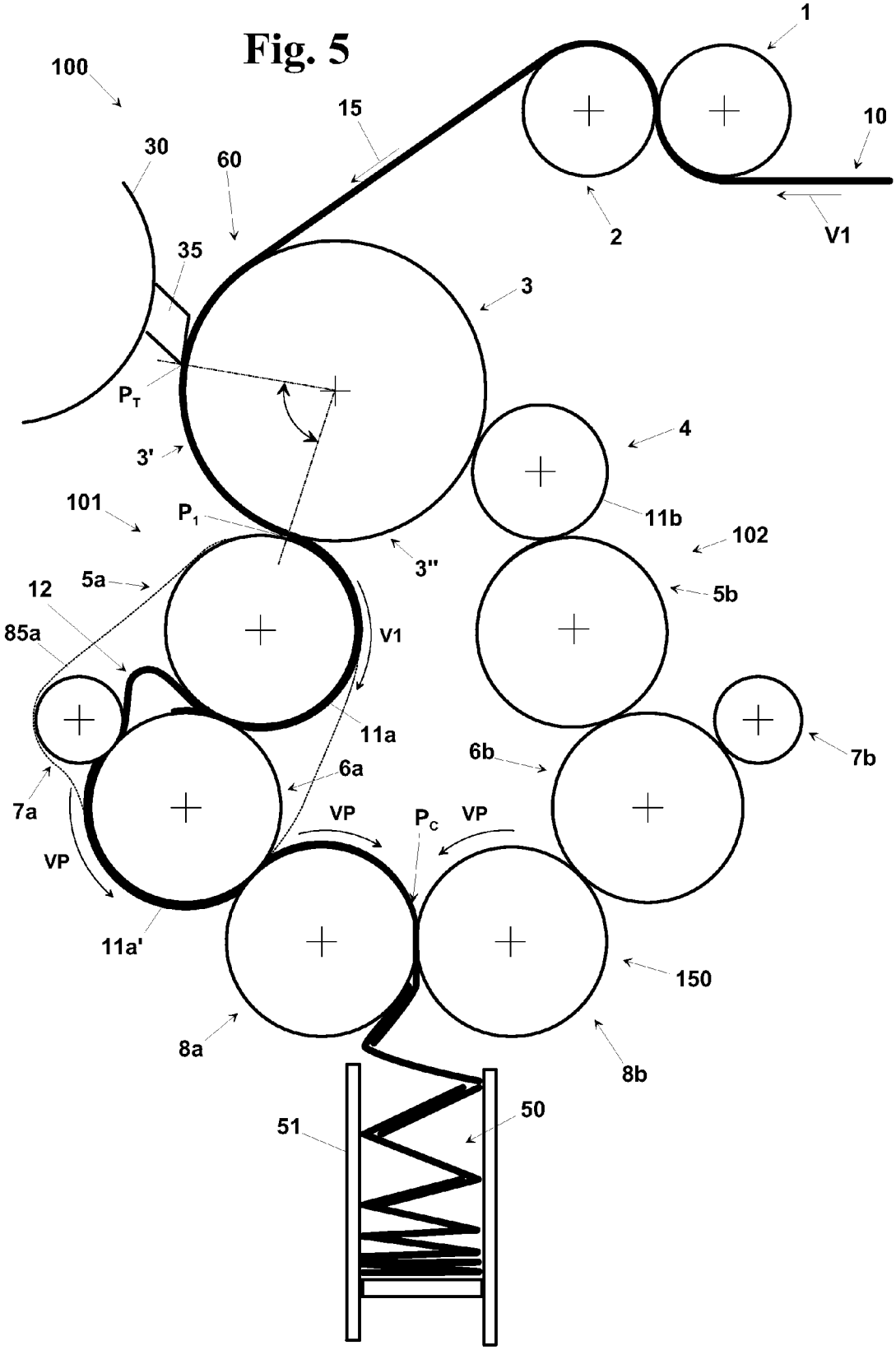
Figure 6:
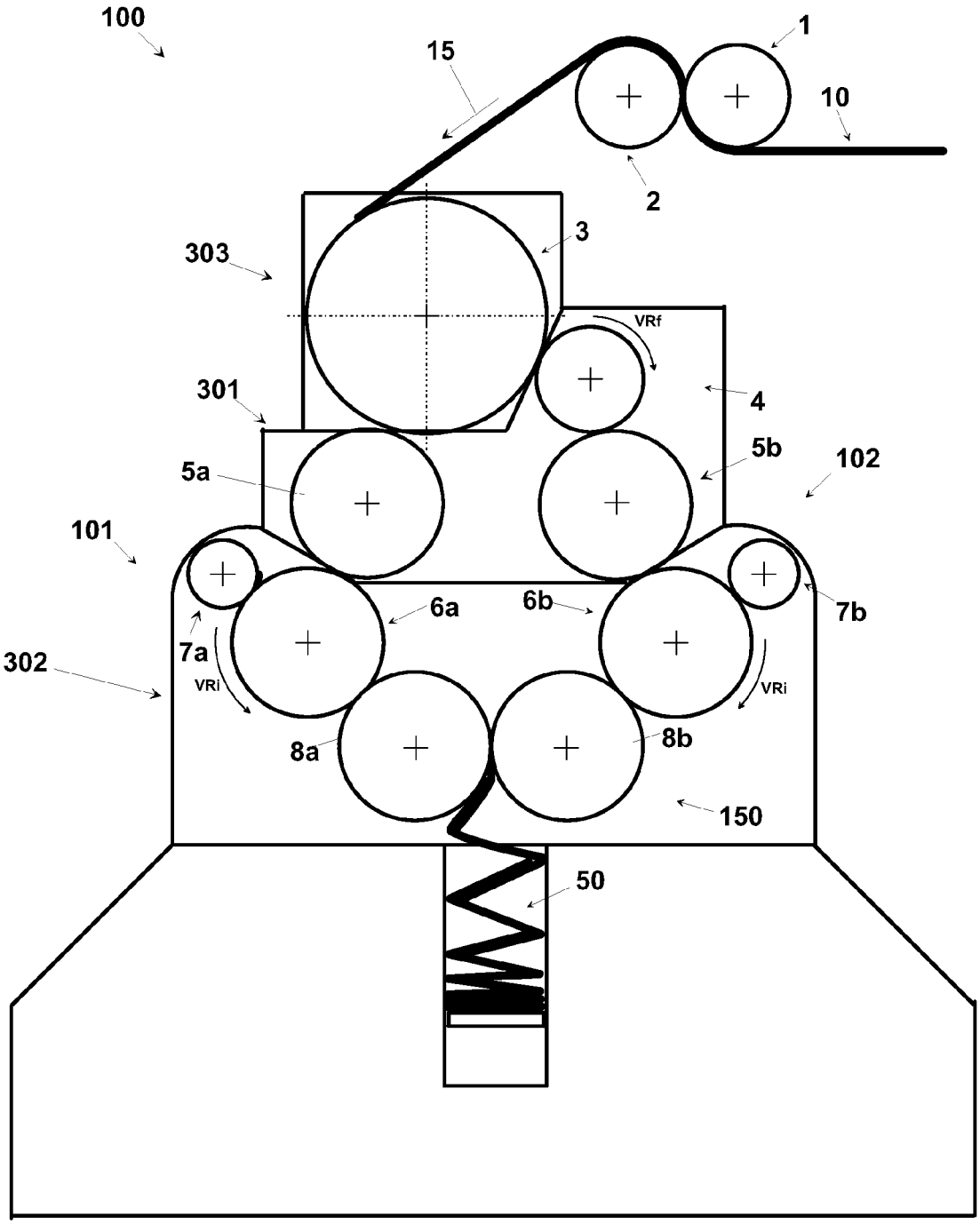
Figure 7:
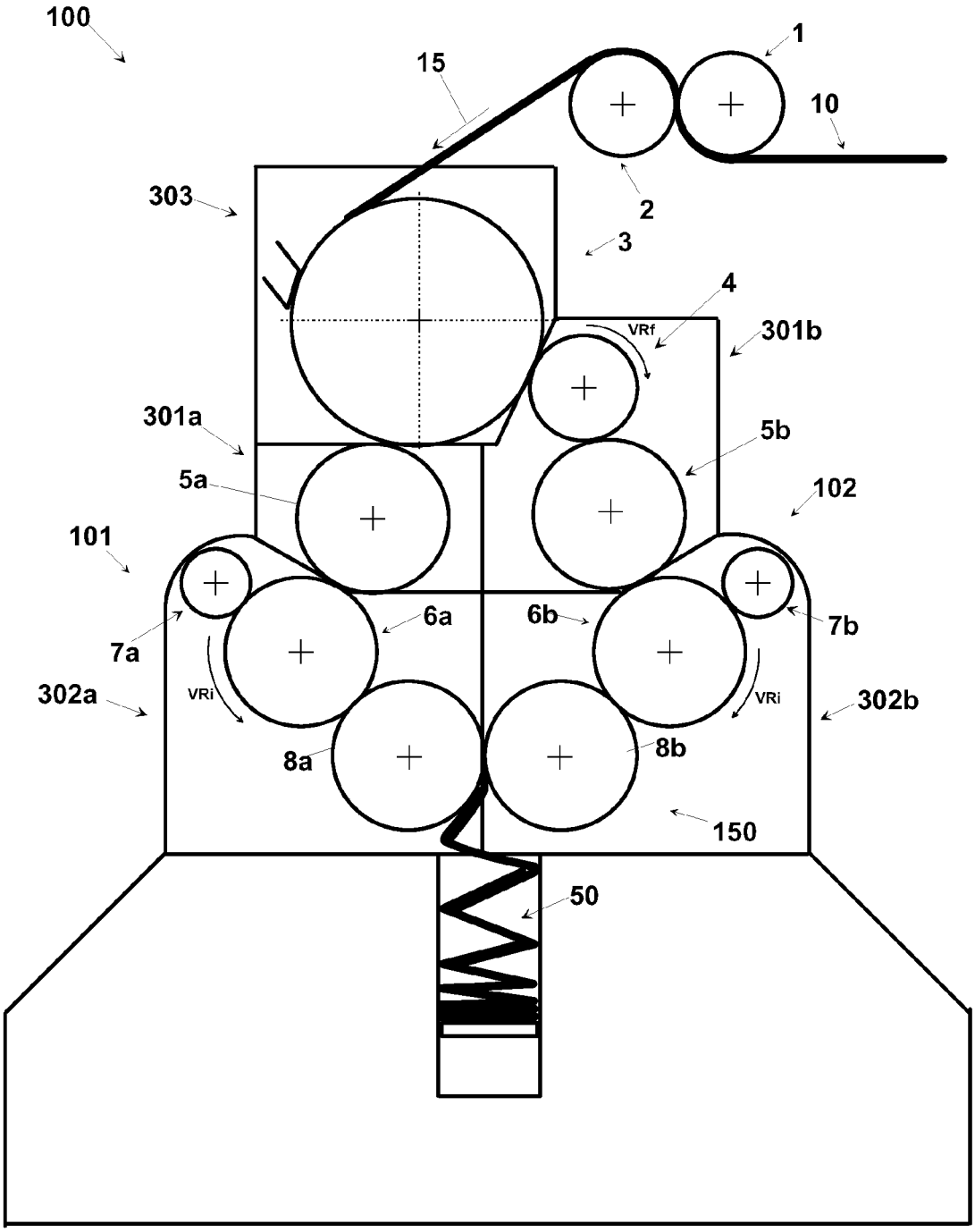
Figure 8:
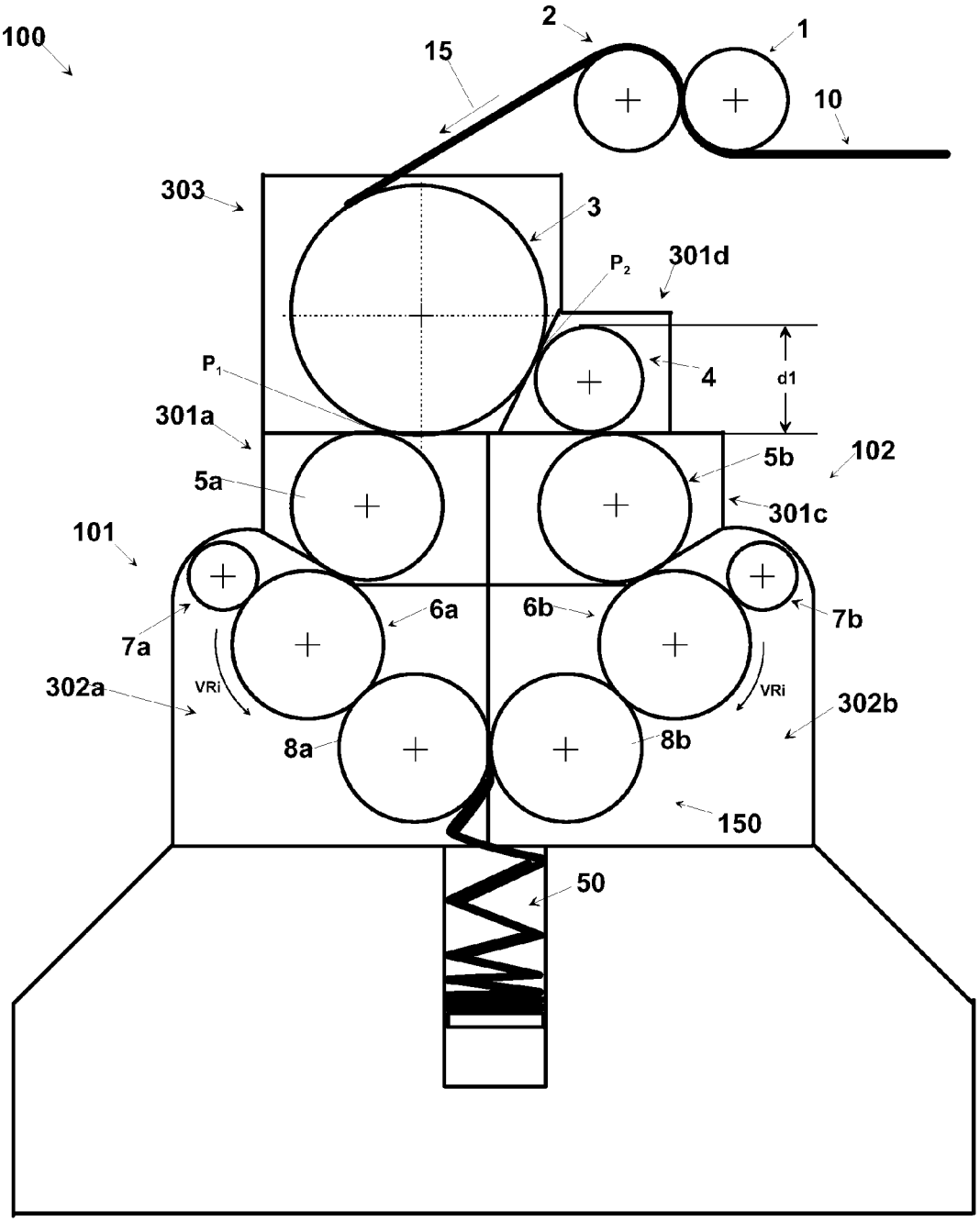
Figure 9:
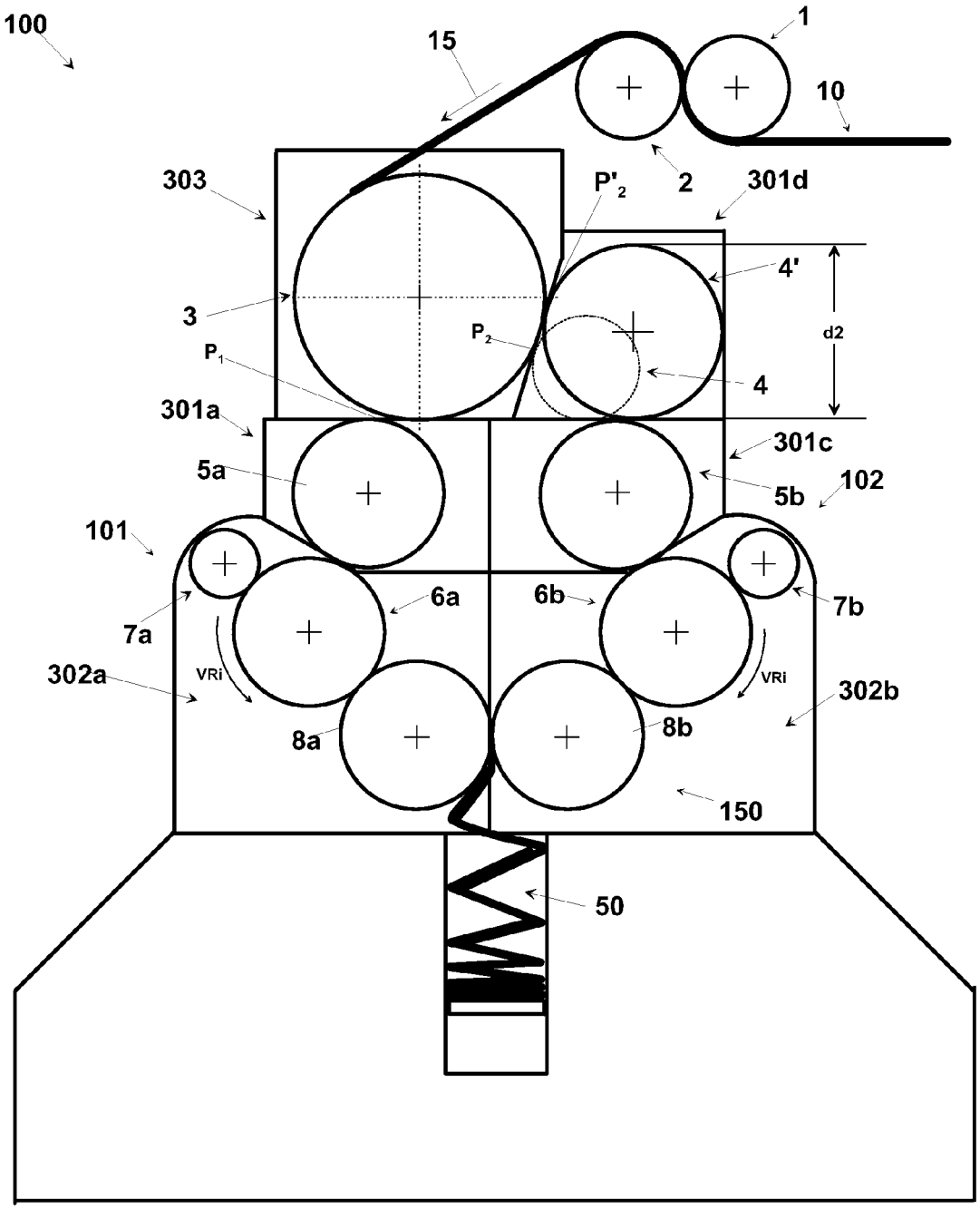

FIGS. from 2 to 4 show the folding and stacking machine of FIG. 1 in different operative steps;

FIG. 5 shows the machine of FIG. 1 with operation in multi-fold way;

FIG. 6 diagrammatically shows another exemplary embodiment of a folding and stacking machine according to the invention, with modular interchangeability of sheet cutting and/or folding units;

FIG. 7 diagrammatically shows an exemplary embodiment of the folding and stacking machine of modular type of FIG. 6;

FIGS. 8 and 9 diagrammatically show a further exemplary embodiment of the folding and stacking machine of modular type of FIG. 6.

DESCRIPTION OF A PREFERRED EXEMPLARY EMBODIMENT

With reference to FIG. 1, a first exemplary embodiment of a folding and stacking machine 100 of a web of paper, or similar products, according to the invention, provides a first sheet feeding line 101 (to the left in the drawing) and a second sheet feeding line 102 (to the right in the drawing).

The machine 100 comprises, furthermore, a folding section 150, comprising a couple of folding rollers 8*a* and 8*b* having a linear folding speed $V_P$. Folding rollers 8*a* and 8*b* are adapted to receive a plurality of sheets 11 of length L that may be overlapped for a fraction Y of their length L and to fold them into a plurality of panels P, creating a stack 50 of folded sheets that is contained between guides 51.

In case a folding mode is selected such that that the fraction Y remains closed within the fold of the sheets, an interfolded product is obtained, according to one or more interfolded panels. In case, instead, the folding mode is selected such that the overlapped fraction Y does not remain closed within the fold of the sheets, a folded but not interfolded product is obtained. Also in case of overlapped sheets a folded but not interfolded product may be obtained.

The folding and stacking machine 100 comprises, furthermore, rollers 6*a* and 6*b* that are adapted to work at a folding speed $V_P$, thus feeding a series of not yet folded cut sheets towards folding rollers 8*a* and 8*b*. Rollers 6*a* and 6*b* are located upstream of a confluence point Pc of the two lines 101 and 102 that feed sheets 11.

Since, according to the invention, upstream of the first and of the second feed lines 101 and 102 a single cutting section 60 is provided that is adapted to cut a web of paper 10 that proceeds along a direction of movement 15 at a speed $V_1$, $V_1$ has a ratio $X_1$ with respect to the folding speed $V_P$. In particular, $X_1$ is higher than 1, preferably 2.

The first and the second feed lines 101 and 102 can be operated selectively and independently, i.e. separately from each other or at the same time, according to the type of interfolded configuration, or desired fold type.

In a first mode of operation, so-called single-fold, diagrammatically shown in FIG. 1, in particular adapted to make an interfolded configuration of L-type, both first feed line 101 and second feed line 102 are operated at the same time.

In this operative configuration, in cutting section 60 paper web 10 is split into sheets 11 of determined length L at a cutting point $P_T$ that is arranged between counter-support element 35 of a fixed counter-support roller 30 and cutting roller 3.

According to the invention, cut sheets 11 follow all the surface of cutting roller 3 for a portion thereof 3', which extends starting from cutting point $P_T$ up to a point of contact $P_1$ of cutting roller 3 with a first roller 5*a* of first feed line 101. Furthermore, only if a sheet has to be delivered to second feed line 102, it follows selectively also a portion 3" of cutting roller 3, which extends, instead, starting from cutting point $P_T$ up to a point of contact $P_2$ of cutting roller 3 with a first roller 4 of second feed line 102.

Every sheet 11*a* that has to follow first feed line 101 leaves, therefore, cutting roller 3 at point $P_1$, whereas every sheet 11*b* that has to follow second feed line 102 leaves cutting roller 3 at point $P_2$.

During a first step, all sheets 11, that have been just cut, adhere to portion 3' of the surface of cutting roller 3 since they are hold by suction through a plurality of holes 31 that are arranged on an angular area that corresponds to a central angle α, and that are put in communication with a vacuum suction system. When sheets 11 reach point $P_1$ they are not any more hold by suction through holes 31 and, if they have to follow feed line 101, they are released onto the roller 5*a*, which in turn has a plurality of suction holes, not shown in the figures, for being then conveyed by the first sheet feeding means along feed line 101.

If, instead, sheets 11 after having followed portion 3' are not hold any more by suction through holes 31, in order to reach second feed line 102 they have to continue to adhere to the surface of cutting roller 3. For this purpose, suction holes 33 are provided in combination with a slotted channel 32, that is adapted to pneumatically connect suction holes 33 with the vacuum suction system. In particular, suction holes 33 are arranged in pneumatic connection with respective ducts 34 that extend longitudinally in cutting roller 3. When ducts 34 reach elongated hole 32, they are put in communication with the vacuum system. Therefore, a suction hole 33 that is in pneumatic connection with corresponding duct 34 holds by suction a sheet 11 on cutting roller 3. Slotted hole 32 extends, in particular, from point $P_1$ to point $P_2$, where suction holes 33, which are not any more in pneumatic connection with the vacuum suction system through slotted hole 32, thus releasing sheets 11 onto roller 4. The latter also has a plurality of suction holes, not shown in the figures, for being then fed by the second sheet feeding means along feed line 102. In the figures only two suction holes 33 are provided, distant 180° from each other, in order to hold one sheet every two sheets at point $P_1$ and bring such sheet to point $P_2$. Roller 3, therefore, has a circumference equal to four times the length of a sheet. Both the length of the sheets and the circumference of roller 3 can be changed in the way shown hereinafter.

Sheets 11 that have followed first feed line 101 form a first plurality of sheets 11*a* that is supplied to folding roller 8*a*. Similarly, sheets 11 that have followed second feed line 102 form a second plurality of sheets 11*b* that are fed to folding roller 8*b*.

The alternation of the two steps above described determines a distance between two successive sheets 11*a* and 11*a*' of first feed line 101 and between two successive sheets 11*b* and 11*b*' of second feed line 102 equal to the length L of a sheet 11. Furthermore, both sheets 11*a* that are fed along first feed line 101 and sheets 11*b* that are fed along second feed line 102 are conveyed at a same speed $V_1$.

Therefore, to ensure that sheets 11*a* of second feed line 102 reach the point of confluence $P_C$ of the two lines 101 and 102, in such a way that they are shifted with respect to sheets 11*a* of first feed line 101, it is necessary that sheets 11*a* follow a path $T_1$ that is longer than the path $T_2$ that is followed by sheets 11*b*. This can be made, for example, by introducing on second feed line 102 a phase reset roller 4, which is adapted to increase the path of second feed line 102 of a determined length (ΔL) with respect to the path of first feed line 101. This way, in order to interfold or to fold sheet 11*b* with sheet 11*a*, the former reaches transfer roller 5*b* in a correct position that is shifted with respect to sheet 11*a*, which at the same time reaches transfer roller 5*a*.

Therefore, the path difference ΔL of sheets 11*b* with respect to the path of sheets 11*a* determines the fraction Y of the length L of sheets 11 for which they overlap each other. For example, in case of L-interfolded sheets the difference of path ΔL is equal to half sheet, i.e. ΔL=L/2. In the case in which the desired overlapping fraction between sheets 11 and 11' is instead less than 50%, for example equal to ¼ of the length L of sheet 11, the phase reset roller 4 has a size that can cause an increase of the length of the path of second feed line 102 with respect to the length of the path of first feed line 101 such that ΔL=L/4.

According to what provided by a preferred exemplary embodiment of the invention, furthermore, both first feed line 101 and second feed line 102 can comprise respective deceleration rollers 6*a* and 6*b* that are adapted to brake the feeding speed of sheets 11, so that speed $V_P$ downstream of each speed deceleration roller 6*a*, or 6*b* is in a ratio X with respect to a speed $V_1$ upstream of it.

In particular, folding roller 8*b* and speed deceleration roller 6*b* of feed line 102, as well as folding roller 8*a* and speed deceleration roller 6*a* of feed line 101, rotate at a same linear speed $V_P<V_1$. This speed difference causes the production of a loop 12, immediately starting from the zone that follows the head of sheet 11.

This allows recovering the gap that is formed between the sheets when they separate from each other at point $P_1$. In fact, if one sheet every two sheets proceeds on feed line 101, the other sheet every two sheets proceeds on feed line 102 such that the two pluralities of sheets meet again at point $P_C$, and owing to the phase reset roller above described they would interfold two by two, but after a couple of interfolded sheets an empty space would follow. Instead, owing to the deceleration step that is caused by the respective deceleration rollers 6*a* and 6*b*, the two pluralities of sheets arrive interfolded at point $P_C$. In particular, in case of a single-fold interfolding machine, it is possible that all the sheets reach point $P_C$ in a way that is overlapped of half sheet with respect to both a previous and a successive sheet.

In another operative condition, for example for operation of the machine to provide multi-fold interfolded or not interfolded products, instead, only first feed line 101 can be operated, whereas second feed line 102 remains still. Or only second feed line 102 can be operated, whereas first feed line 101 remains still.

In the first case, the slotted hole 32 is separated by the vacuum suction system, therefore sheets 11 are fed only to transfer roller 5*a*, which in turn transfers sheets to speed deceleration roller 6*a*. Speed deceleration roller 6*a* in this second operative condition is adapted to cause an overlap of two following sheets 11 and 11' in a movement along first feed line 101, i.e. it acts as an overlap roller as known in interfolding or folding multi-fold stacking machines of the prior art. More precisely, up to transfer roller 5*a*, sheets 11 travel along a transfer path at a speed $V_1$, whereas starting from the overlap roller 6*a*, sheets 11 are conveyed at a second speed $V_P$, with $V_P$ less than $V_1$. This speed difference causes sheets 11 and 11' to overlap, since sheet 11, having speed $V_1$, is put below sheet 11' downstream of it, since it has a speed $V_P$ less than $V_1$. The chosen overlapping fraction Y between the two sheets 11 and 11', corresponding to a predetermined number of panels, allows the folding rollers 8*a* and 8*b* to make a desired type of folded packs.

This way, it is possible to obtain different interfolded configurations, for example "W" or interfolding types, in a way similar as it can be obtained with traditional multi-fold machines. Alternatively, it is possible to obtain a variety of interfolded configurations, such as in the way described in EP08156875.0, in the name of the same applicant or in EP1826165, replacing modular parts for adjusting the length of the panels, or the cut-off length, i.e the length of the sheets, etc.

Alternatively, (in a way not shown but obvious for a skilled person), the machine can operate with only second feed line 102 working, and by replacing cutting roller 3, in order to have holes 33 in a number that is enough to pick up the sheets at point $P_1$ and bring them up to point $P_2$, or having the holes 31 activated from point $P_T$ up to point $P_2$.

In an exemplary embodiment shown in FIG. 6 the machine 1 provides a modular structure comprising a plurality of removable portions, for example three removable portions 301, 302 and 303. A first removable portion 301, or module, comprises rollers 4, 5*a* and 5*b*, i.e. the rollers that work at the linear speed $V_1$, and, in particular, the phase reset roller 4 that causes the difference of path length ΔL between the two feed lines 101 and 102. Similarly, a second removable portion 302, or module, can be provided such that all rollers and transmission parts that work at the linear speed $V_P$ can be replaced and, in particular, the deceleration rollers 6*a* and 6*b* with the respective paper tensioning rollers 7*a* and 7*b*, as well as folding rollers 8*a* and 8*b*. Finally, a third removable portion 303, or modular portion, comprises the cutting roller and its drive means (gearing, belts of transmission, etc.), for changing the cut-off length of the sheets.

In the solution of FIG. 7 five removable portions are provided and precisely:

- a modular portion 303, comprising the cutting roller and its drive means (gearing, belts of transmission, etc.), for change the cut-off length of the sheets;
- a modular portion 301*a* that moves at a speed $V_1$, comprising the transfer roller 5*a* and its drive means;
- a modular portion 302*a*, comprising rollers 6*a*, 7*a* and 8*a* and their drive means for rotating at a speed $V_P$;
- a modular portion 301*b* that moves at a speed $V_1$, comprising transfer roller 5*b* and its drive means;
- a modular portion 302*b*, comprising rollers 6*b*, 7*b* and 8*b* and its drive means for rotating at a speed $V_P$.

This way, the many modules can be changed, in order to provide an extremely flexible machine where the following operations are allowed:

- operation as single-fold machine,
- operation as multi-fold machine,
- choosing the width of the panels, and then the width of the packs,
- choosing the number of panels,
- choosing the cut-off length.

In an exemplary embodiment shown in FIGS. 8 and 9, instead of modular portion 301*b* of FIG. 7, two modular portions 301*c*, which comprises only roller 5*b*, and 301*d*, which comprises the only phase reset roller 4, are provided that are replaceable independently from one another. This way, it is possible to replace the phase reset roller 4 with a phase reset roller 4' of different size, for example of diameter $d_2$ higher than diameter $d_1$ of phase reset roller 4, for changing the length of the fraction of overlapped sheets 11. In this case, handling means are advantageously provided, in a way not shown in the figures, which according to the diameter $d_2$ shift suitably shift reset roller 4' with respect to cutting roller 3 and to roller 5*b*. The change of a phase reset roller 4 with a phase reset roller 4' of different diameter causes, in fact, a variation of the angular distance between point $P_1$, i.e. the tangent point of cutting roller 3 with roller 5*a*, and point $P_2$, i.e. the tangent point of cutting roller 3 with roller 5*b*. In the case shown in FIG. 9, for example, the change of the phase reset roller 4 of FIG. 8 with the phase reset roller 4' causes an increase of the angular distance $P_1P_2$.

It is also possible, in a way not shown, to change both cutting roller 3 and phase reset roller, either as a single modular portion or as two distinct modules.

The foregoing description of a specific embodiment will so fully reveal the invention according to the conceptual point of view, so that others, by applying current knowledge, will be able to modify and/or adapt for various applications such an embodiment without further research and without parting from the invention, and it is therefore to be understood that such adaptations and modifications will have to be considered as equivalent to the specific embodiment. The means and the materials to realise the different functions described herein could have a different nature without, for this reason, departing from the field of the invention. It is to be understood that the phraseology or terminology employed herein is for the purpose of description and not of limitation.

The invention claimed is:

1. A folding and stacking machine for making packages of folded and stacked sheets starting from a web of paper, or similar material, the machine comprising:

- a folding section comprising a first and a second folding roller, said first and second folding rollers adapted to fold said sheets into a plurality of panels and to form a stack of folded sheets;
- a first sheet feed line arranged to feed a first plurality of sheets to said folding rollers;
- a second sheet feed line that is distinct from said first sheet feed line, said second sheet feed line being arranged to feed a second plurality of sheets to said folding rollers;
- a sheet supply line, arranged upstream of said first and said second sheet feed lines, for unwinding and conveying a single web of paper according to a feeding direction;
- a cutting unit arranged to cut said single web of paper, coming from said feeding direction, into sheets of paper having a determined length L; and
- a distribution roller arranged to distribute alternatively, and selectively, said sheets of paper to said first sheet feed line, and to said second sheet feed line.

2. The folding and stacking machine according to claim 1, wherein said cutting unit is arranged to cut said web of paper into sheets against said distribution roller.

3. The folding and stacking machine according to claim 1, wherein said distribution roller comprises:

- a first hold sector for holding, by suction, said sheets on a first angular portion of the surface of said distribution roller, and
- a second hold sector for holding, alternately, said sheets on a second angular portion of the surface of said distribution roller, such that when said second hold means holds said sheets on said second angular portion, a sheet is supplied to said second plurality of sheets on said second feed line, whereas when said second hold sector does not hold said sheets on said second angular portion, a sheet is supplied to said first plurality of sheets on said first feed line.

4. The folding and stacking machine according to claim 3, wherein said first angular portion extends substantially from a point downstream of said cutting unit up to a tangent point between said distribution roller and a first roller of said first feed line, whereas the second angular portion extends substantially from said tangent point between said distribution roller and said first roller of said first feed line and a tangent point between said distribution roller and a second roller of said second feed line.

5. The folding and stacking machine according to claim 3, wherein said distribution roller comprises a plurality of suction holes, said first hold sector comprising a first suction connector that is adapted to pneumatically connect said suction holes with a vacuum system at said first angular portion of said roller, for holding said sheets on said first angular portion, and said second hold connector comprises a second suction connector that is adapted to selectively connect said suction holes with said vacuum system at said second angular portion of said roller, for selectively holding on said second angular portion only sheets that have to form said second plurality of sheets.

6. The folding and stacking machine according to claim 1, wherein a means is provided to create a path-length difference between the path of the second feed line and the path of the first feed line, said path-length difference being such that the sheets of the first and second pluralities of sheets reach the folding section according to a determined configuration.

7. The folding and stacking machine, according to claim 6 wherein said means to create a path-length difference comprises at least one phase reset roller in at least one among said first and said second sheet feed lines.

8. The folding and stacking machine according to claim 7, wherein said, or each, phase reset roller is adapted to extend the path of said second feed line with respect to said first feed line for a length ΔL that is equal to half sheet, or equal to an odd multiple of half sheet.

9. The folding and stacking machine according to claim 7, wherein said phase reset roller is independently removable as a unit in order to change the length of the sheet, the width of the sheet, and the folding configuration.

10. The folding and stacking machine, according to claim 7, wherein said phase reset roller can be replaced with a modular equivalent portion, but of different diameter in order to obtain a different delay of the sheets of the second feed line.

11. The folding and stacking machine according to claim 1, wherein said first and said second feed lines each comprise a first portion in which said sheets are brought to a first speed $V_1$ and a second portion that is downstream of said first portion in which said sheets are brought to a second speed $V_P$, with $V_P<V_1$.

12. The Molding and stacking machine according to claim 11, wherein said first feed line comprises a first speed deceleration roller arranged to decelerate the feeding speed of said first plurality of sheets from $V_1$ to $V_P$ before said first plurality of sheets reaches said first folding roller, and wherein said second feed line comprises a second speed deceleration roller arranged to decelerate the feeding speed of the second plurality of sheets from $V_1$ to $V_P$ before they reach the second folding roller.

13. The folding and stacking machine according to claim 12, wherein said speed deceleration roller is arranged to act as an overlap roller, and, according to a ratio X between the speed $V_1$ upstream of the speed deceleration roller and the speed $V_P$ downstream of the speed deceleration roller, a corresponding portion Y of the length L of a sheet being overlapped to a next sheet obtaining a determined interfolded configuration.

14. The folding and stacking machine, according to claim 13, wherein, in said first operative condition, said first feeding speed $V_1$ has a ratio $X_1$ with respect to the folding speed $V_P$, said ratio selected from the group comprised of:

$X_1$=3/2, for Z-type folded sheets with one interfolded panel;

$X_1$=4/2, for W-type folded sheets with two interfolded panels;

$X_1$=5/4 for five panel folded sheets with one interfolded panel;

$X_1$=6/3, for six panel folded sheets with three interfolded panels;

$X_1$=6/4 for six panel folded sheets with two interfolded panels.

15. The folding and stacking machine according to claim 1, wherein a first actuating means is provided that is adapted to selectively start and stop said first sheet feed line, and a second actuating means is provided that is arranged to selectively start and stop said second sheet feed line, and further comprising a drive unit arranged to operate said first and second actuating means between a first and a second configuration, in such a way that:

in said first configuration, said actuating means of said second feed line is stopped and said machine operates in a multi-fold way, interfolded or not interfolded, with sheets that are fed only through said first feed line;

in said second configuration, said second actuating means is operated so that the sheets of said first plurality and the sheets of said second plurality reach, through the respective first and second feed lines, a point of confluence, so that said machine operates in a single-fold way.

16. The folding and stacking machine according to claim 1, wherein said folding section is independently removable as a unit with respect to said cutting unit, said folding section comprising at least two folding rollers and being replaceable with an equivalent unit.

17. The folding and stacking machine according to claim 1, wherein said folding and stacking machine has a support frame for supporting the distribution roller, the folding rollers, and the transfer rollers, and the removable portion of the folding section is independently removable as a unit from the support frame of the machine, so that the folding rollers are removed as a unit, or as two sub-units, and can be replaced with an equivalent portion, wherein said, or each, portion also comprises the supports of the rollers and the transmission parts, already set with respect to one another.

18. A folding and stacking machine for making packages of folded and stacked sheets starting from a web of paper, or similar material, the machine comprising:

a folding section comprising a first and a second folding roller, said first and second folding rollers adapted to fold said sheets into a plurality of panels and to form a stack of folded sheets;

a first sheet feed line arranged to feed a first plurality of sheets to said folding rollers, and a second sheet feed line, which is distinct from said first sheet feed line, and which is arranged to feed a second plurality of sheets to said folding rollers, a sheet supply line arranged upstream of said sheet feeding section for unwinding and conveying a single web of paper according to a feeding direction, a cutting unit arranged to cut said single web of paper, coming from said feeding direction, into sheets of paper having a determined length L, a distribution roller arranged to distribute alternatively, and selectively, said sheets of paper to said first sheet feed line, and to said second sheet feed line, and a means to create a path-length difference between the path of the second feed line and the path of the first feed line, said path-length difference being such that the sheets of the first and second pluralities of sheets reach the folding section according to a determined configuration, and wherein said means to create a path-length difference comprises at least one phase reset roller in at least one among said first and said second sheet feed lines.

* * * * *